US008864393B2

(12) United States Patent
Castells et al.

(10) Patent No.: US 8,864,393 B2
(45) Date of Patent: Oct. 21, 2014

(54) MEDIA ADVANCE

(75) Inventors: Raimon Castells, Barcelona (ES); Francisco Guerrero, Barcelona (ES); Abel Martinez, Barcelona (ES); Carles Flotats, Barcelona (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 534 days.

(21) Appl. No.: 12/819,251

(22) Filed: Jun. 21, 2010

(65) Prior Publication Data

US 2011/0311290 A1 Dec. 22, 2011

(51) Int. Cl.
*B41J 11/00* (2006.01)
*B41J 11/42* (2006.01)

(52) U.S. Cl.
CPC ..... *B41J 11/42* (2013.01)
USPC ..... 400/582; 400/578

(58) Field of Classification Search
USPC ..... 400/582
See application file for complete search history.

(56) References Cited

U.S. PATENT DOCUMENTS

| | | | | |
|---|---|---|---|---|
| 5,089,712 | A * | 2/1992 | Holland | 250/557 |
| 6,118,132 | A * | 9/2000 | Tullis | 250/559.39 |
| 6,454,474 | B1 * | 9/2002 | Lesniak et al. | 400/582 |
| 6,759,671 | B2 * | 7/2004 | Liess et al. | 250/559.32 |
| 7,380,898 | B2 | 6/2008 | Plante et al. | |
| 7,391,525 | B2 | 6/2008 | Chapman et al. | |
| 7,703,873 | B2 | 4/2010 | Liu et al. | |
| 7,763,875 | B2 * | 7/2010 | Romanov et al. | 250/559.29 |
| 7,907,120 | B2 * | 3/2011 | Gordon et al. | 345/166 |
| 7,934,787 | B2 * | 5/2011 | Yoshida | 347/16 |
| 2001/0004284 | A1 * | 6/2001 | Fukuda et al. | 355/29 |
| 2003/0126962 | A1 * | 7/2003 | Bland et al. | 83/13 |
| 2004/0179217 | A1 * | 9/2004 | Chapman et al. | 358/1.12 |
| 2006/0050333 | A1 * | 3/2006 | Yang | 358/504 |
| 2006/0274102 | A1 * | 12/2006 | Yoshikawa et al. | 347/16 |
| 2007/0098476 | A1 * | 5/2007 | Goeree et al. | 400/636 |
| 2007/0193681 | A1 * | 8/2007 | Smith et al. | 156/277 |
| 2009/0002429 | A1 | 1/2009 | Puigardeu et al. | |
| 2009/0142082 | A1 | 6/2009 | Ferran et al. | |
| 2010/0078870 | A1 | 4/2010 | Fellingham et al. | |

FOREIGN PATENT DOCUMENTS

| | | | |
|---|---|---|---|
| JP | 2002337433 | A | 11/2002 |
| JP | 2007210765 | A | 8/2007 |

* cited by examiner

*Primary Examiner* — Anthony Nguyen

(57) ABSTRACT

Calibrating a media drive, comprising advancing media with a media drive while detecting media advances within the printer, determining an error in the media advances, and calibrating the media drive so as to at least partly compensate for the determined error.

14 Claims, 10 Drawing Sheets

MEDIA ADVANCE

BACKGROUND OF THE INVENTION

Media advance accuracy is an important parameter for any type of printer. Media advance concerns the media moving over a predetermined distance and/or at a predetermined speed, with respect to a print head, to allow the print head to print subsequent strokes on the media, in a controlled manner. A lack of accuracy in media advance may result in non-aligned print drops or strokes, and defects such as banding or grain. Media advance accuracy is important for every print technology. Print technologies include, but are not limited to, inkjet and laser driven print systems.

To improve media advance accuracy, the media drives of printers are oftentimes calibrated. This reduces the amount of error in the media drive, and as a consequence the banding and grain may be reduced. Such media drive calibration can be carried out at different moments, for example at the factory site, at the end of the manufacturing process, during installation at the customer site, or during a service operation, for example when replacing a component such as a main roller or an encoder disc.

A common calibration method involves printing specially arranged lines and/or fiducial marks on the media. After printing, the media is taken out of the printer and scanned by an external scanning tool to allow automatic processing of the printed lines and/or marks. From these lines and/or marks, information about the media advances can be derived. Subsequently the media drive can be calibrated, based on this information, to compensate for the errors that were detected.

A similar calibration method involves printing lines and/or marks, then taking the media from the printer, and placing it onto a print platen in transverse direction.

Then the printed plot is scanned by a line sensor that is present in the print head carriage.

BRIEF DESCRIPTION OF THE DRAWINGS

For the purpose of illustration, certain embodiments of the present invention will now be described with reference to the accompanying diagrammatic drawings, in which.

DETAILED DESCRIPTION

In the following detailed description, reference is made to the accompanying drawings. The embodiments in the description and drawings should be considered illustrative and are not to be considered as limiting to the specific embodiment of element described. Multiple embodiments may be derived from the following description and/or drawings through modification, combination or variation of certain elements. Furthermore, it may be understood that also embodiments or elements that are not literally disclosed may be derived from the description and drawings by a person skilled in the art.

Figure 1:
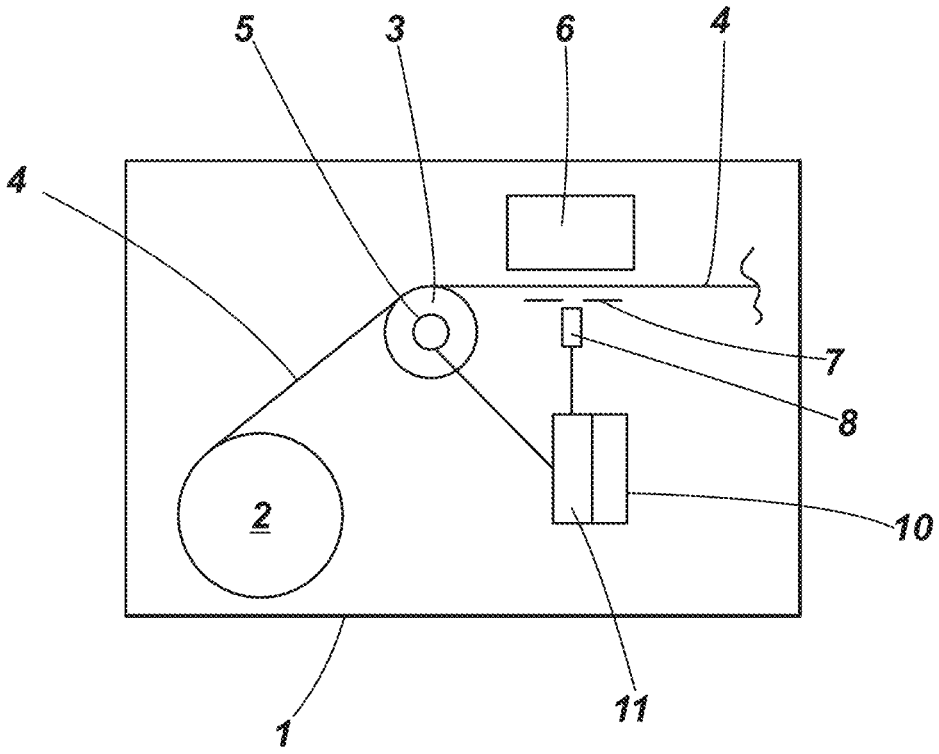
FIG. 1 shows a diagram of a part of an embodiment of a printer with a media advance calibration system.

In FIG. 1 a printer 1 is shown. The printer 1 may comprise a large format printer, for example for handling media widths of approximately 0.75 meters or more, or approximately 2 meters or more. In the shown embodiment, the printer 1 may comprise an inkjet printer, for example a thermal inkjet or a piezo inkjet printer. In other embodiments, the printer 1 may comprise a laser driven printer, for example a liquid ink laser printer, or a dry ink laser printer. In these cases, ink is often referred to as toner. Moreover, the printer 1 of this disclosure may be arranged to dispense fluids, toners, and/or other substances.

The printer 1 may comprise rollers and/or axes 2, 3 for advancing media 4 through the printer 1. The printer 1 may comprise a media roll 2 and a drive roller 3. The printer 1 may comprise further rolls that may aid in advancing the media 4 but that are not shown in the drawing. The media roll 2 may be a consumable roll, adapted to unwind and be replaced within the printer 1. The drive roller 3 may be arranged to advance the media 4 from the media roll 2. The drive roller 3 may form part of, and be driven by, a media drive 5, in FIG. 1 schematically illustrated as a media drive axis. An embodiment of a media drive 5 is illustrated and discussed in more detail with reference to FIG. 2.

The printer 1 may comprise a printhead 6. The printhead 6 may comprise any type of printhead, for example an inkjet printhead for printing a plurality of colors, amongst which Cyan, Magenta, Yellow and Black, or the like, and others. The printhead 6 may comprise a scanning printhead 6 arranged to scan across the width of the media 4. The media drive 5 may be arranged to advance the media 4 between each one or more scanning actions of the printhead 6. In another embodiment, the printhead 6 may comprise a page wide printhead. In again another embodiment, the printhead may comprise a transfer mechanism for liquid or dry toner, for example for a laser driven printer.

The printer 1 may comprise a media support 7. The media support 7 may support the media 4 near the printhead 6. The printer 1 may comprise a media surface detector 8, configured to detect media advances within the printer 1. The media surface detector 8 may be configured to detect a non-printed media material texture. The media surface detector 8 may comprise an optical detector embedded in the printer 1. The media surface detector 8 may comprise an optical media advance sensor. An embodiment of an optical media advance sensor 8 is explained below with reference to FIG. 3. The media surface detector 8 may be arranged to detect advances in the media 4 near the printhead 6. The media surface detector may be arranged along the media path, to detect the media surface texture.

The media surface detector 8 may be adapted to measure media advances. In this disclosure, a media advance may refer to a distance of a media movement. In an embodiment, the media advance may comprise a distance that is moved in one step to allow the media to be printed in swaths. In one embodiment, the media may move relatively continuously, wherein the media advance may comprise intermediate distances that the media is moved, or one full distance corresponding to a full print that the media is moved.

For scanning print heads 6, The media 4 may be printed when it is held relatively stationary between media advances. A media advance may require the media 4 to move a relatively precise and repeatable distance, for example by first accelerating, then moving at constant velocity, and then decelerating. In this disclosure, the media surface detector 8 may be used to calibrate the media drive 5 so that the media advance may be more accurate than before calibration.

The printer 1 may comprise a memory device 10, which may comprise a digital, non-volatile storage unit. The memory device 10 may store parameters that correspond to a certain media drive movement. The parameters may determine the motion of the media drive 5. The parameters may be configured to correspond to a certain effective diameter of the respective rollers 3. The parameters may be set at manufacturing. The parameters may be arranged in a table. The parameters may be configured to adjust the drive roller 3 frequency to compensate for irregularities in the radius of the roller 3. Typical parameters may correct a deviation in the radius of the roller 3, as well as an eccentricity of the roller 3.

In an embodiment of this disclosure, calibration of the media drive 5 may be achieved by calibrating the parameters stored in the memory device 10. The parameters may be configured to compensate for a single frequency cycle very turn, which may relate to a roller 3 having a certain eccentricity. The parameters may compensate for a couble frequency cycle at every turn of the roller 3, which may relate to a certain elliptical shape in the roller 3. The parameters may compensate for slip of the media 4 with respect to the roller 3. An embodiment of this disclosure relates to adapting the parameters by advancing and detecting media 4 within the printer 1.

The printer 1 may comprise a processor 11. The processor 11 may comprise a controller for controlling the media drive 5 in accordance with the parameters and/or a media drive algorithm. The processor 11 may comprise a digital signal processor (DSP) for processing the signals received from the media surface detector 8.

The processor 11 may further be configured to determine an error in a detected media advance, in accordance with the signals outputted by the media surface detector 8. The error in the media advance may comprise a difference between a measured media advance and a desired media advance. For example, a desired media advance may comprise approximately 44 millimeters, or for example a distance between 1 and 1000 millimeters. If an error in the media advances is determined by the processor 11, it may adapt at least one of the parameters stored in the memory device 10 so as to decrease the level of error, so that the measured media advance is closer to the desired media advance. The parameters may be adapted manually, automatically or semi-automatically. Since having a media advance error of zero is practically impossible, a certain media advance error may be allowed as long as it does not exceed certain predetermined threshold values. The memory device 10 may store such threshold values.

The printer 1 may comprise a media drive calibration system that is integrated with the printer 1. The media drive calibration system may comprise the media surface detector 8 and the memory device 10 storing said parameters and/or at least one comparison threshold value corresponding to respective parameters. The media drive calibration system may further comprise the processor 11 configured to, on the one hand, derive the media advance distance from the incoming detector signals, and, on the other hand, adapt a parameters when a detected media advance error corresponding to that parameter exceeds said at least one threshold value.

Figure 2:
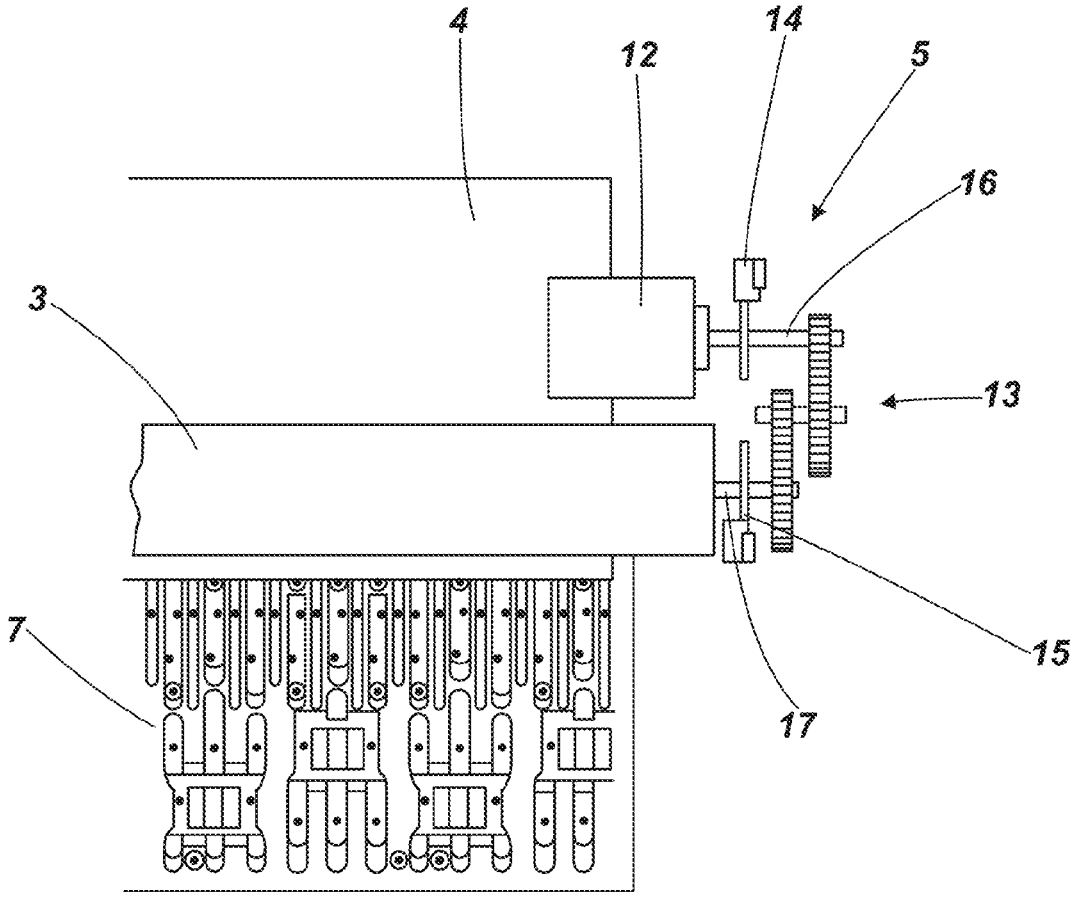
FIG. 2 shows an embodiment of a media drive.

FIG. 2 illustrates an embodiment of a media drive 5. The drive roller 3 may form part of the media drive 5. The media drive 5 may comprise a media drive motor 12, for example an electromotor and/or a DC servomotor. The media drive 5 may comprise a transmission 13, for transmitting the movement of the media drive motor 12 to the drive roller 3. The transmission 13 may comprise wheels, belts, etc.

The media drive 5 may comprise an encoder 14, 15, for example such encoder 14, 15 may be connected to one or both of a motor output axis 16 and a drive roller axis 17. The encoder 14, 15 may allow determination of a certain angular position of a motor axis so as to allow a relatively precise control of that axis. The encoder 14, 15 may be provided with encoder units arranged along a full circle. In an embodiment, the encoder units may comprise markings, for example lines or points, that may be detectable by optical recognition. The encoder 14, 15 may comprise an optical sensor for recognizing the encoder units. The encoder may comprise a transparent disc. The encoder units may comprise markings arranged over 360 degrees of the transparent disc, wherein each encoder unit may correspond to a respective angle the respective axis, for example the drive axis 17. For example, the encoder may comprise more than 2000 encoder units evenly distributed over 360 degrees along the circumference of the disc. This may allow a relatively exact determination of the angular position of a roller or axis connected to the drive 5, for example the drive roller 3.

In an embodiment, a certain number of encoder units may correspond to a certain media advance. In an embodiment, the parameters may associate certain numbers of encoder units to a corresponding media advance. For example, a predetermined number of encoder units may correspond to a 180 degrees turn of a drive axis 17 and/or of the drive roller 3. Correspondingly, the 180 degrees movement of the drive roller 3 may result in a media advance of a certain number of centimeters, millimeters or micrometers, depending on the print swath settings. The drive roller 3 may be rotated over a predetermined angle, for example corresponding to 1000 encoder units, in accordance with the desired media advance.

Figure 3:
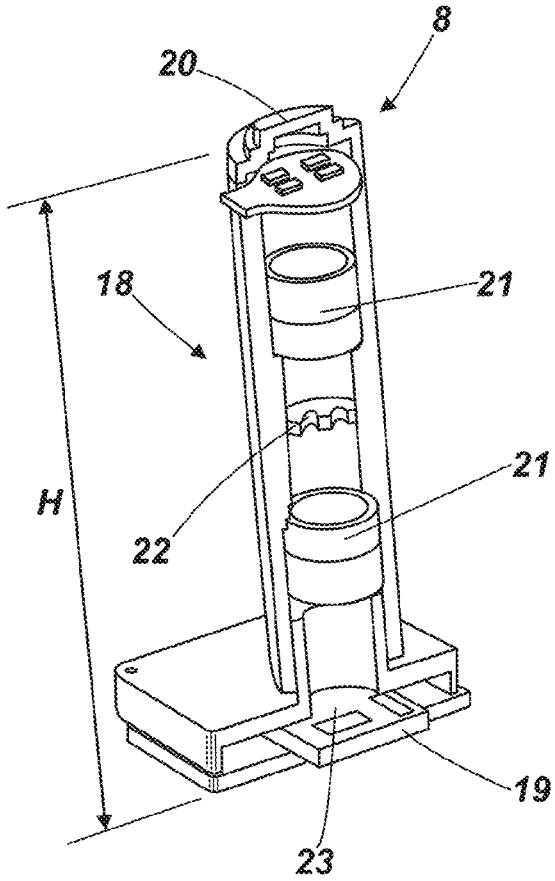
FIG. 3 shows an embodiment of a media surface detector in a cross sectional, perspective view.

In FIG. 3 an embodiment of a media surface detector 8 is shown. The media surface detector 8 may allow a direct measurement of the media advance. The media surface detector 8 may comprise an optical detector, for example provided with an image sensor 23 such as a high resolution CCD or CMOS chip. The media surface detector 8 may be adapted to take digital images of the surface of the media 4. The surface may comprise a texture. By applying pattern recognition to the surface texture, shifts of the media surface may be detected, as will be explained below. By applying recognition of the surface texture of the media 4, no printed marks are necessary and the media may afterwards be used for printing. In an embodiment, a high resolution media surface detector 8 may be used, for example having a resolution of at least 300 pixels per inch, or at least 600 pixels per inch, or at least 900 pixels per inch, or at least 1200 pixels per inch, or at least 2000 pixels per inch. An embodiment of the media surface detector has a resolution of approximately 2540 pixels per inch. Such relatively high resolutions may allow better matching of texture structures having microscopic irregularities.

The media surface detector 8 may comprise an optical assembly 18 and a printed circuit board 19. The optical assembly 18 may comprise a hardened glass window that may be in contact with the back side of the media 4 to establish focus. A light source such as light emitting diodes 20 may be provided to provide adjustable and/or uniform illumination. The optical assembly 18 may comprise a lens system 21 and/or an aperture plate 22, to project an image of the media surface texture onto an image sensor 23. A circuit may be provided to drive the LEDs in a flashing mode so as to be able to freeze the motion on the image sensor 23.

The media surface detector 8 may be connected to the processor 11 and the memory device 10. The media surface detector 8 may be connected to the digital signal processor (DSP). Further interface circuitry may be provided to aid in signal processing, and to connect the detector 8 in the printer 1.

Figure 4:
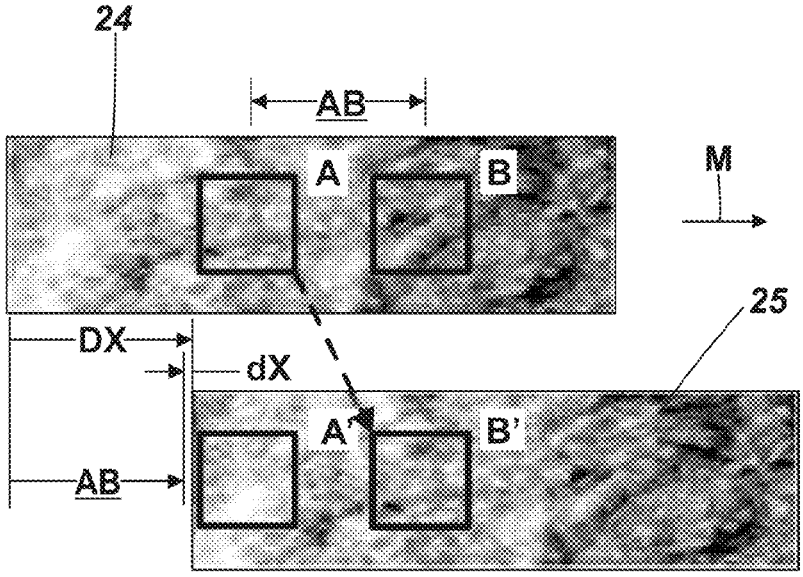
FIG. 4 shows an embodiment of detecting a media advance.

An embodiment of a method of detecting media advances is shown in FIG. 4. The media surface detector 8 may capture a digital image 24, and for example store at least two regions A, B within the image 24 in the memory device 11. The at least two regions may correspond to different pixels on the same image sensor chip. These two regions may be separated by a predetermined distance AB, for example approximately 3.5 millimeter. The distance AB may correspond to a media advance [?]. As the media moves in a media advance direction M, a second image 25 with a second set of regions A', B' may be captured, for example after the media 4 has moved over a distance DX. The portion captured within region A of the first image may now have moved to the second region B' of the second image. However, while the drive 5 may have been programmed to advance the media 4 over said distance AB, the media surface detector 8 may detect an error dX with respect to said distance AB, dX being the difference between DX and AB. Hence, a media advance error dX may be detected.

In an embodiment, matching of regions A and B' may be performed by optical correlation techniques. The matching may be performed with known pattern recognition techniques. In certain embodiments FFT correlation and/or least squares correlation may be applied.

For an embodiment having a distance AB of approximately 3.5 millimeters, about 13 captures may be processed for a media advance of approximately 44 millimeters. A total media advance error dXi may be calculated for a full media advance step. Also smaller or larger media advances may be detected for errors, for example in ranges of between 1 and 1000 millimeters, or between 10 and 100 millimeters. Also intermediary media advance errors may be calculated for a longer continuous movement, for example having a media advance of several centimeters, decimeters, or meters.

Figure 5:
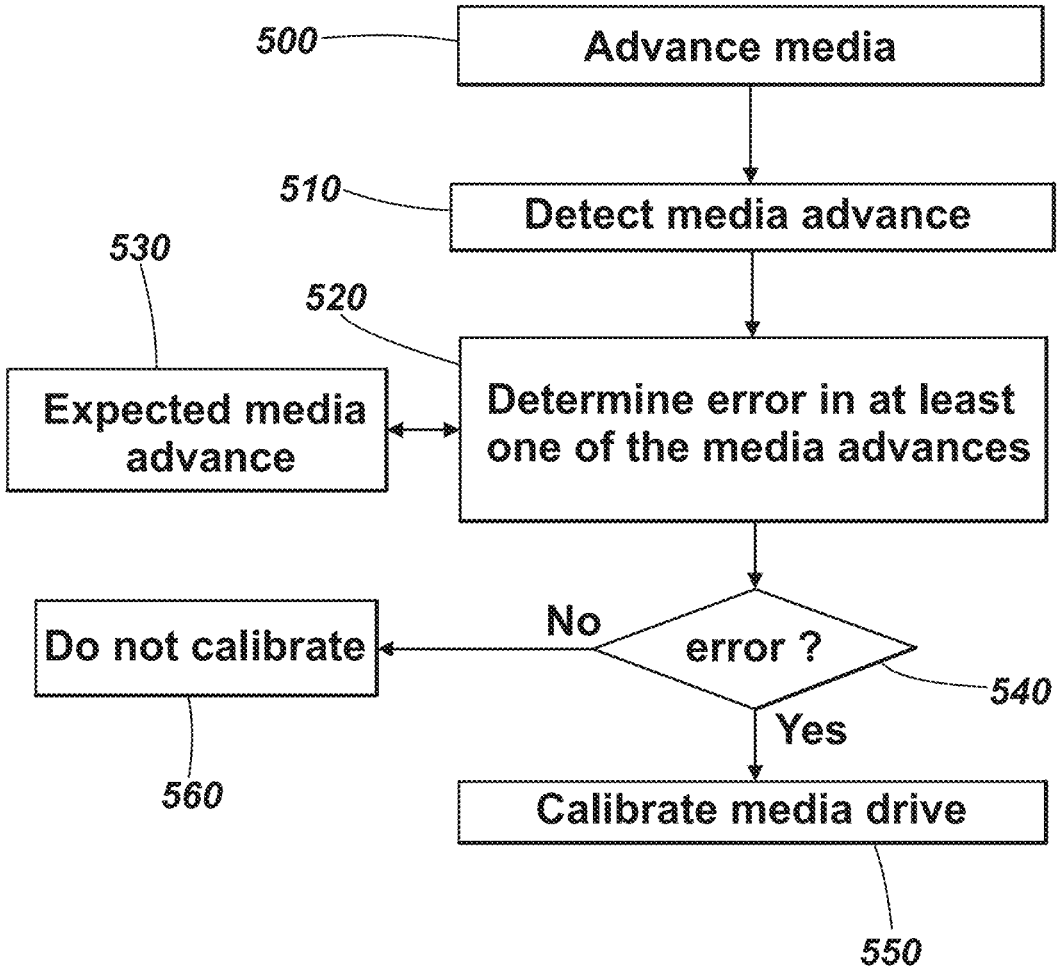
FIG. 5 shows a flow chart of an embodiment of a method of calibrating a media drive in a printer.

An embodiment of a method of calibrating a media drive 5 is shown in FIG. 5. In certain embodiment, this method is applied at the end of manufacturing the printer 1, at installation of the printer 1, and/or during a service operation of the printer 1, for example when placing a new media roll 2 in the printer 1. However, this method may be applied at any moment. The method of calibrating the media drive 5 may comprise advancing media 4 through the printer 1, as indicated by block 500. The method may comprise detecting the media advances within the printer 1, as indicated by block 510, for example by the media surface detector 8. The media surface detector 8 may be mounted onto the printer 1, for example along the media path so that the detector 8 extends against or close to a surface of mounted media 4. The method may comprise determining an error in the media advances, as indicated by block 520. The error may comprise a deviation of the detected media advance, with respect to an expected or desired media advance, as indicated by block 530. If such error is detected (block 540), the media drive 5 may be calibrated, as indicated by block 550. The media drive 5 may be calibrated so as to at least partly compensate for the determined error. For example, the number of encoder units associated with a particular angular range of the drive roller 3 may be altered so as to better correspond with the expected media advance. If no error is detected (block 540), further calibration may be redundant, as indicated by block 560.

Figure 6:
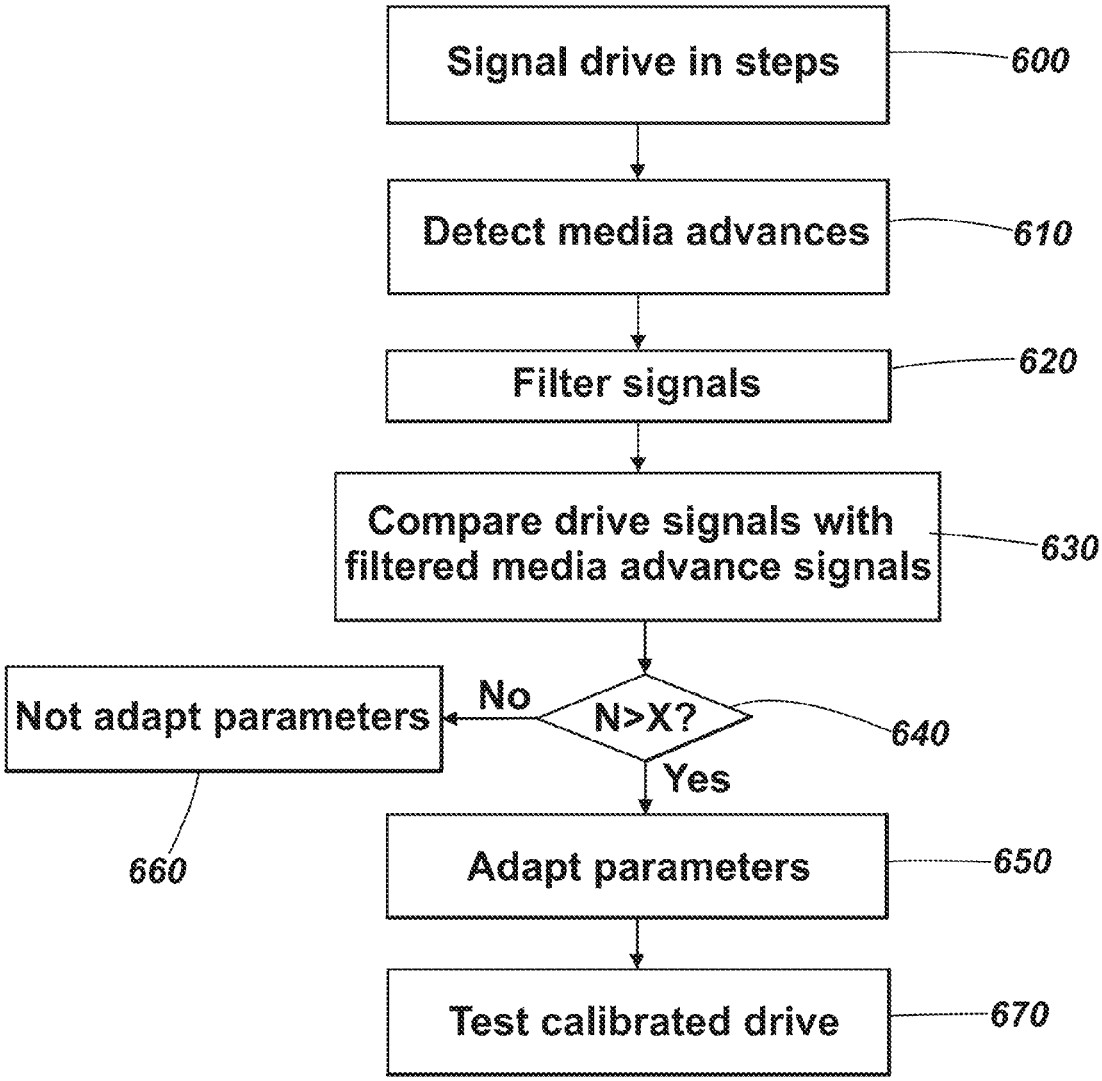
FIG. 6 shows a flow chart of a further embodiment of a method of calibrating a media drive in a printer.

FIG. 6 shows a flow chart of a further embodiment of calibrating a media drive 5. In the method of calibrating, the drive 5 is signaled to advance the media 4, in a block 600. The drive 5 may advance the media 4 in steps according to predetermined distances, for example of approximately 3.5 millimeters, or for example of between 0.1 and 10 millimeters, for example depending on predetermined parameters that are stored in the memory device 10.

The media surface detector 8 may detect the media advances that result from the movement of the drive roller 3, as indicated by block 610. The media surface detector 8 may detect the distance the media has advanced at each step. For example, each step may deviate between 0.001 and 0.05 millimeters from the desired media advance.

The processor 11 may apply a mathematical transformation to the incoming detected media advance signals, as indicated by block 620. The transformation may filter out irregularities such as residual errors in the incoming detected media advance signals, so that media advance errors that reoccur with certain regularity, for example at each drive roller rotation, may be distinguished. Such reoccurring errors may for example correspond to an eccentricity in a drive roller 3. The detected media advance signals may be filtered using any suitable mathematical transformation, for example a Fourier Transform or a Fast Fourier Transform.

Figure 8:
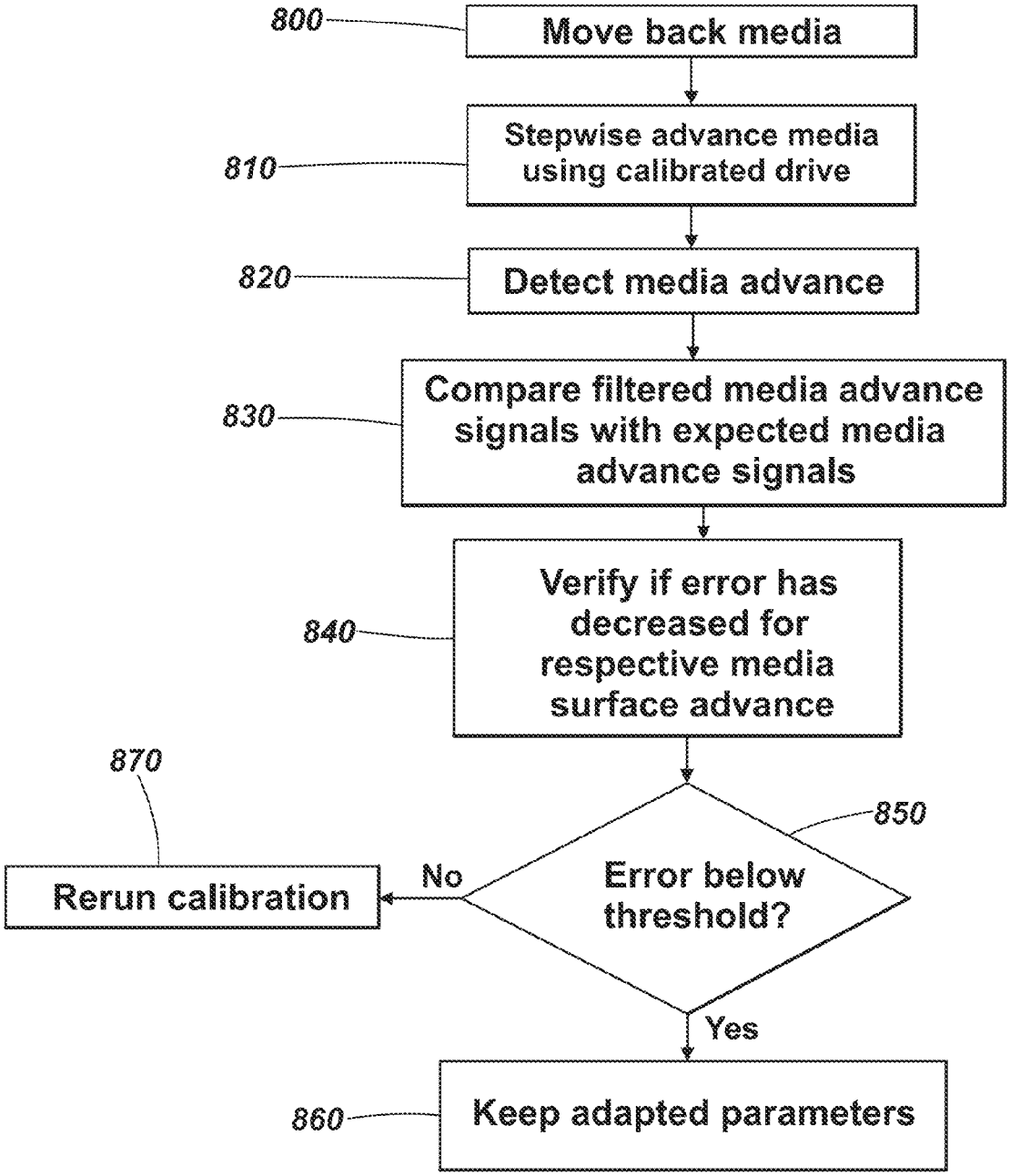
FIG. 8 shows a flow chart of an embodiment of a method of printing media that was used for calibrating the media drive.

After transforming, drive advance signals may be compared with the transformed detected media advance signals, in block 630. The drive advance signals correspond to the expected media advances. Discrepancies N between the drive advance signals and the media advance signals may be determined through said comparison. When the discrepancies N exceed a certain predetermined threshold X (block 640), the processor 11 may adapt the parameters for signaling the drive 5, as indicated by block 650, and store the altered parameters in the memory device 10. The processor 11 may adapt the parameters only for the drive advance signals that correspond to the determined discrepancy. Other parameters may remain in the memory device 10 without being adapted. Where the discrepancies do not exceed said threshold, the corresponding parameters may not be adapted, as indicated by 660. After the parameters were adapted so as to calibrate the drive 5, the calibrated drive 5 may be tested, as indicated by block 670, and as will be explained with reference to FIG. 8.

The parameters may be configured so that each media advance may be associated with a predetermined angular rotation of the drive 5 in an optimized manner. The parameters may be configured so that each media advance is associated with a number of encoder units that correspond to said angular rotation. Accordingly, in a block 650, the parameters may be adjusted so as to also adapt the number of encoder units associated with the media advance containing the error.

In an embodiment, a menu may be presented, and an operator and/or service operator may select a calibration option from the menu wherein the media roll 2 is advanced and the calibration may be self executed, for example in accordance with the series of blocks 600-670. The calibration method may be executed without the use of external devices. No or little waste may be produced by the calibration method, because the media portion used for calibration is still clean afterwards, and can therefore be re-used for commercially printing.

Figure 7:
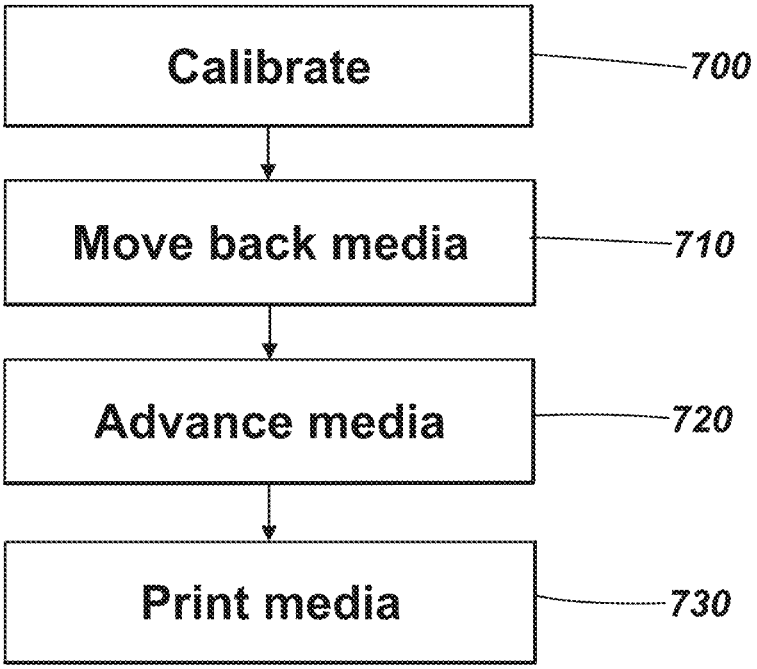
FIG. 7 shows a flow chart of an embodiment of a method of verifying a calibrated drive algorithm.

After the calibration method the same media portion that was used for calibration may be printed with an image for delivering the printed product. FIG. 7 illustrates a method of printing the media 4 with such media portion used for calibration. The media 4 may be calibrated, as indicated by block 700, for example as explained with reference to FIGS. 5 and/or 6. After calibration, the media portion that was used for calibration may be moved backwards so as to reposition the media 4 for printing. The media 4 may be moved or rolled back, in a direction opposite to the advance direction, as indicated by block 710. Then, the media 4 may again be advanced through the printer 1, as indicated by block 720, but using the calibrated media drive 5. The media 4 may be advanced through the printer 1 using an at least partly adapted parameter set. The media 4 may be printed using the calibrated media drive 5, as indicated by block 730. In this method, the media portion that was used for calibration is now printed, and no or little waste has been produced.

After the calibration method, as explained with reference to FIGS. 5 and 6, the calibrated media drive 5 may be tested, so as to verify whether the error has sufficiently decreased. An embodiment of such test method can be explained with reference to FIG. 8. The test method may be executed after calibrating the drive 5 and/or before printing. After the calibration method has been carried out, the media 4 may be rolled back onto the media roll 2, as indicated by block 800. However, in another embodiment, the media 4 the test method may be carried out after the calibration method without rolling back the media 4. The media 4 may be advanced by the calibrated media drive 5, as indicated by block 810. The media 4 may be advanced using the adapted parameters. The media 4 may be advanced in a stepwise manner. The media surface detector 8 may detect the media advances, as indicated by block 820. The detected media advance may be outputted by the detector 8 as signals. The signals may be transformed in approximately the same manner as in the calibration method. The processor 11 may compare the transformed media advance signals with the expected media advances, as indicated by block 830. For example, a media advance is expected to be approximately 3.5 millimeters. A corresponding drive advance signal may be given to the media drive 5, using the adapted parameters stored in the memory device 10. A resulting media advance may be measured using the media surface detector 8. The detected media advance may be compared with the expected media advance. The processor 11 may verify if the error has decreased for the respective media advances, as indicated by block 840. The processor 11 may verify if the media advance corresponding to an earlier measured error in the surface of the drive roller 3 now has a decreased error due to the calibration. A threshold may be applied for verifying whether the error has decreased so as to allow a certain error margin that does not or hardly affect print quality. In block 850, it may be verified whether the adapted parameters are acceptable by verifying whether the detected errors are below the threshold. If the error does not exceed the threshold, or if no error is detected, the adapted parameters may remain stored in the memory device, as indicated by block 860, and the adapted parameters may be used for printing. If the error exceeds an acceptable threshold value, the adapted parameters may not be acceptable, and the calibration method may be run over again, as indicated by block 870.

To verify whether the calibration method has been successful using the mentioned test method, it may be sufficient to advance the media 4 over a relatively small distance, as compared to the advanced distance of the calibration method. For example, for the calibration method, the media 4 may be advanced over a distance that corresponds to at least approximately 3, or at least approximately 4, or at least approximately 5 rotations of the media drive 5. For the test method, it may be sufficient to advance the media over a distance corresponding to approximately 3 or less rotations, or approximately 2 or less rotations, or approximately 1 rotation or less of the media drive 5. In this way the test method will take significantly less time than the calibration method and may be executed relatively rapidly.

Figure 9:
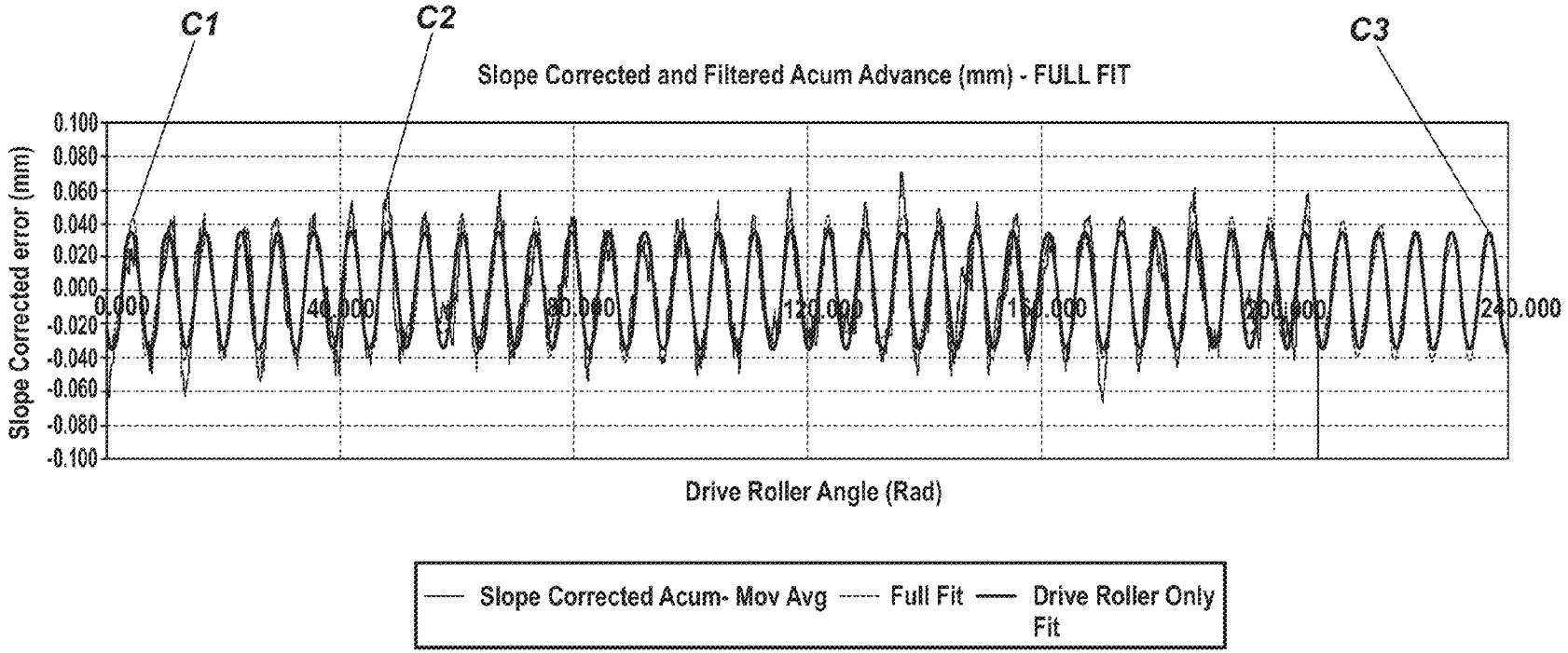
FIG. 9 shows a graph containing test results with detected media advance errors of an embodiment of a printer.

FIG. 9 shows a graph wherein test results are plotted. The graph plots slope corrected errors in millimeters, on the vertical axis, against a feed roller (=drive roller 3) angle in radians, on the horizontal axis. In this description, the slope corrected error may be understood as the media advance error. The "slope correction" may be understood as the correction of the actual media advance in the function, so that the error remains. The graph plots the test results measured over 240 radians in total. The first curve C1 plots samples of the signal values, as measured without applying any transformation. The second curve C2 shows a graph of the measured signals after applying a first transformation. The first transformation may be a Fast Fourier Transform or similar function. The first transformation may be configured so as to plot the media advance error for the frequencies of 1; 1.9 (approximately) and 2, shown in FIG. 10 as E, F and G, respectively. The second curve C2 may show the regular errors relating to deviations in the drive roller surface and in a diverter roller surface. Other irregularities were filtered out by the first transformation. The third curve C3 shows a graph of the measured signals after applying a second transformation. The second transformation may also be a Fast Fourier Transform or similar function. The second transformation may be configured so as to plot the media advance error for the frequencies 1 and 2, shown as E and G in FIG. 10. The third curve C3 may show more regularity, as compared to the second curve C2.

Figure 10:
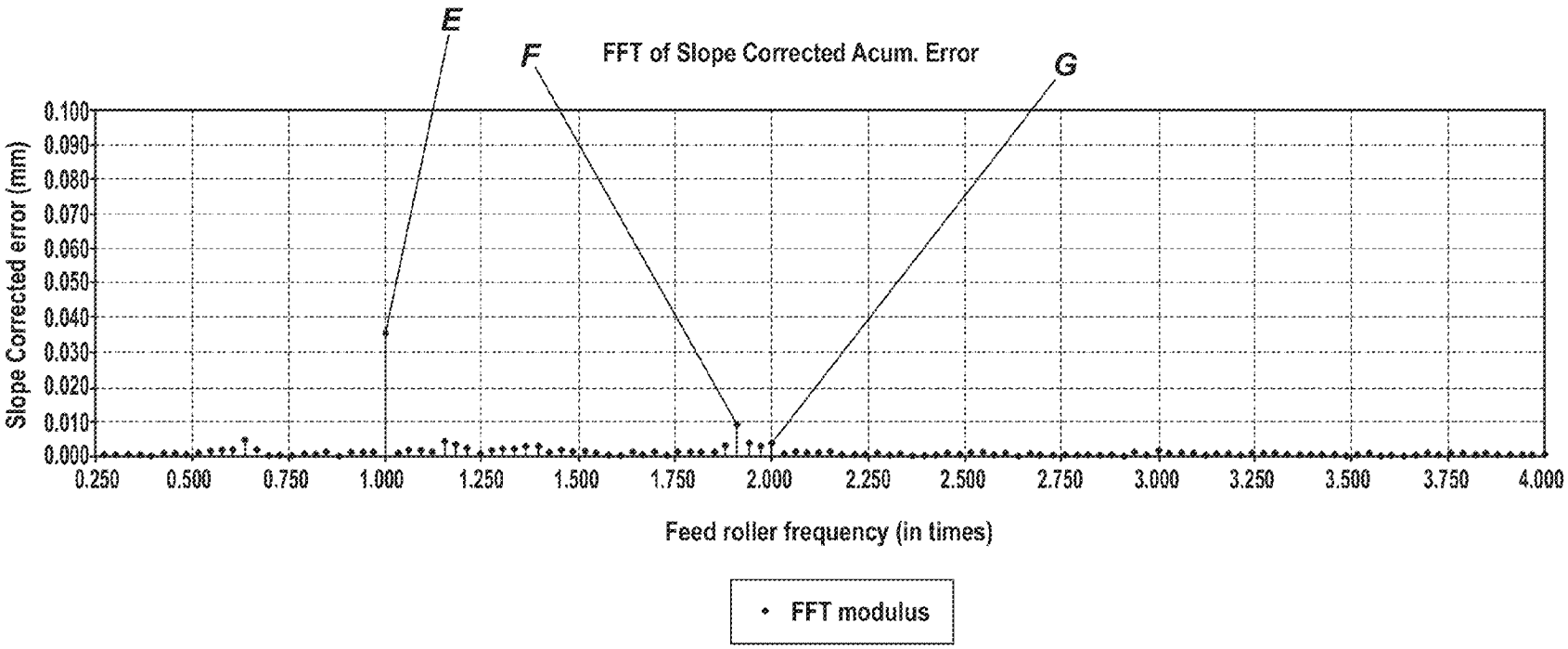
FIG. 10 shows a graph plotting media advance errors of the printer embodiment of FIG. 9 after applying a Fast Fourier Transform to FIG. 9.

FIG. 10 plots a Fourier Transform of the media advance error with the frequencies along the horizontal axis, and their amplitudes in millimeters of error along the vertical axis. The frequencies are indicated in times per turn of the drive roller 3. The graph shows a first regular media advance error E of approximately 0.035 millimeter, at a frequency of 1 every turn of the drive roller 3. The first regular media advance error E may relate to a deviation in the radius of the drive roller 3. The first media advance error E may relate to an eccentricity of the drive roller 3. The graph shows a second regular media advance error F of approximately 0.009 millimeter, at a frequency of approximately 1.9 times every turn of the drive roller 3. The second regular media advance error F may relate to a deviation in the radius of a diverter roller (not shown). The graph shows a third regular media advance error G of approximately 0.004 millimeter, at a frequency of 2 times every turn of the drive roller 3. The third regular media advance error G may relate to a deviation in the radius of a drive roller 3.

Figure 11:
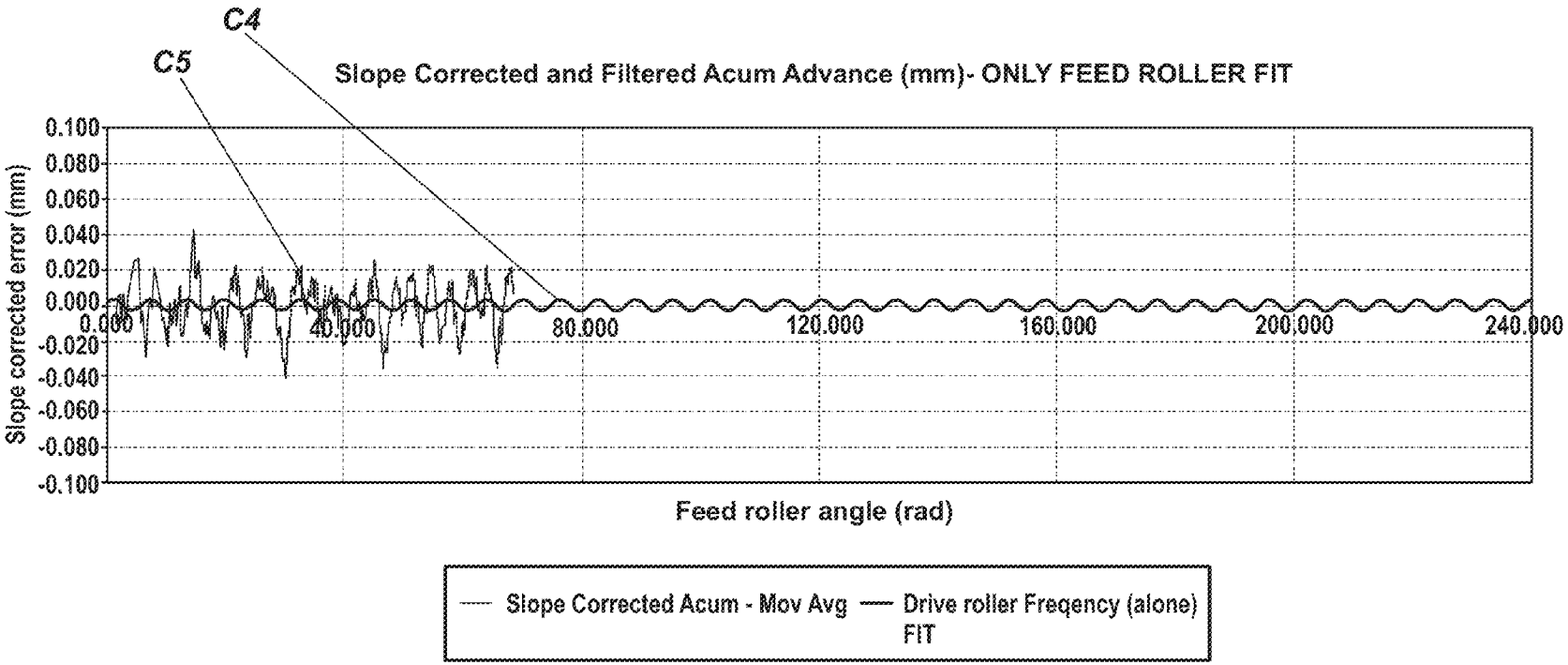
FIG. 11 shows a graph containing test results of detected media advance errors, after adapting the parameters for controlling the drive of the printer embodiment of FIGS. 9 and 10.

FIG. 11 plots the results of measured signals in a similar manner as FIG. 9. Here, the signals were measured after the drive 5 was calibrated by adapting the parameters. A fifth curve C5 shows samples of the measured signals without applying a transformation, including residual errors. The fourth curve C4 shows the results after applying a Fast Fourier Transform that filters the residual errors. For the fourth curve C4, the regularly occurring media advance errors, relating to the nominal deviations in the surface shape of the driver roller 3, were calibrated. In an embodiment, the parameters were calibrated so as to compensate for the error as depicted by curve C3 [?].

The remaining media advance error may for example be approximately 0.004 millimeter or less.

Embodiments of the printer 1 may have a drive roller 3 that is arranged before or after the printhead 6. Further rolls may be provided in the printer 1, before and after the support 7. The printer 1 may comprise a final drive roller and/or pinch wheels. In principle at least one detector 8 may be provided. The media advance calibration system and method may be configured to detect deviations in any of these rolls. Accordingly, one or more media surface detectors 8 may be arranged at one or multiple locations along the media path.

The method and system of this disclosure may prevent that media needs to be printed for calibration. The method and system of this disclosure may prevent that external devices, separate from the printer 1, need to be applied for performing the printer calibration. The media drive 5 of the printer 1 may be calibrated at any site, for example, at the printing site or manufacturing site. The printer 1 may be calibrated multiple times, for example at multiple service operations, during the full lifetime of the printer 1. The method of calibration may be performed automatically.

In certain embodiments the cost savings of the calibration method and system has been calculated to be around approximately 30 USD per calibration performed on the printer 1, as compared to traditional calibration methods. Cost savings may be made by preventing media waste, ink consumption and saving operator time.

Defects that may relate to deviations in the surface of one of the drive rollers 3 may be prevented. For example, it has been shown that by applying the calibration method and system of this disclosure, image defects such as banding and grain were prevented or decreased.

The above description is not intended to be exhaustive or to limit the invention to the embodiments disclosed. Other variations to the disclosed embodiments can be understood and effected by those skilled in the art in practicing the claimed invention, from a study of the drawings, the disclosure, and the appended claims. The indefinite article "a" or "an" does not exclude a plurality, while a reference to a certain number of elements does not exclude the possibility of having more elements. A single unit may fulfil the functions of several items recited in the disclosure, and vice versa several items may fulfil the function of one unit.

In the following claims, the mere fact that certain measures are recited in mutually different dependent claims does not indicate that a combination of these measures cannot be used to advantage. Multiple alternatives, equivalents, variations and combinations may be made without departing from the scope of the invention.

The invention claimed is:

1. Method of calibrating a media drive in a printer, comprising advancing media through the printer with the media drive while detecting media surface texture to detect media advances within the printer, determining an error in the media advances, calibrating the media drive so as to at least partly compensate for the determined error, advancing a media portion that was used for calibration through the printer and printing on said media portion.

2. Method according to claim 1, comprising determining drive advances, wherein the error comprises a discrepancy between a media advance and a corresponding drive advance.

3. Method according to claim 2, comprising using a processor to convert the detected media advances into media advance signals, applying a transformation to the detected media advance signals, and determining a discrepancy between drive advance signals and the corresponding media advance signals.

4. Method according to claim 1, comprising stepwise advancing the media, and detecting an advanced distance of the media surface between each step.

5. Method according to claim 1, wherein detecting media advances comprises optically detecting the media surface texture and applying pattern recognition to the media surface texture to detect shifts of the media surface.

6. Method according to claim 1, wherein detecting media advances comprises optically detecting a non-printed media surface texture.

7. Method according to claim 1, wherein the error corresponds to a deviation in the surface shape of a drive roller.

8. Method according to claim 1, comprising advancing the media through the printer using parameters stored in a memory device, adapting the parameters, at least for a drive angle range associated with the measured error, and advancing the media through the printer using the adapted parameters.

9. Method according to claim 8, wherein the media drive comprises encoder units each corresponding to respective angles of a drive axis, and each media advance is associated with a number of encoder units through said parameters, the method further comprising adapting the parameters so that the number of encoder units that is associated with the media advance corresponding to the error is adapted.

10. Method according to claim 1, comprising detecting, within the printer, the media advances driven by the calibrated media drive, and verifying whether the error has decreased.

11. Printer, comprising a media drive arranged to advance media through the printer, a memory device storing parameters for controlling the media drive, a media surface detector embedded in the printer, arranged to detect media surface texture to detect media advances, and a processor, configured to determine an error in a detected media advance, and adapt at least one of the parameters so as to decrease the error, wherein the printer prints on a media portion used for calibration.

12. Printer according to claim 11, wherein the media surface detector is arranged along the media path, and the media surface detector comprises an optical detector that is arranged to detect a non-printed media material texture, and recognize a displacement of the detected media.

13. Printer according to claim 11, wherein the media drive comprises an encoder provided with encoder units, each encoder unit corresponding to a respective angle of the media drive, the memory device stores a drive algorithm configured to associate certain numbers of encoder units to corresponding media advances according to the given parameters, and the processor is configured to adapt the parameters by correcting the number of encoder units associated with a media advance that contained the error.

14. Media drive calibration system, comprising a detector arranged to detect a non-printed media material texture, a memory device storing parameters for outputting drive advance signals for advancing the media over predetermined distances and at least one threshold value corresponding to respective parameters, a processor configured to derive the media advance distance from the detector signals, calculate a media advance error by comparing the derived media advance distance with the corresponding predetermined distance, and adapt a parameter when the media advance error corresponding to the parameter exceeds said at least one threshold value, wherein media material advanced through the media drive calibration system is used for printing.

* * * * *

UNITED STATES PATENT AND TRADEMARK OFFICE

CERTIFICATE OF CORRECTION

PATENT NO. : 8,864,393 B2
APPLICATION NO. : 12/819251
DATED : October 21, 2014
INVENTOR(S) : Raimon Castells et al.

It is certified that error appears in the above-identified patent and that said Letters Patent is hereby corrected as shown below:

In the Claims

In column 9, line 53, in Claim 1, after "error," insert -- and --.

Signed and Sealed this
Second Day of June, 2015

Michelle K. Lee

Michelle K. Lee
*Director of the United States Patent and Trademark Office*